US005653606A

United States Patent [19]

Chrysostomou

[11] Patent Number: 5,653,606

[45] Date of Patent: Aug. 5, 1997

[54] ELECTRICAL INTERCONNECTION SYSTEM HAVING RETENTION AND SHORTING FEATURES

[75] Inventor: Chrysostomos Petros Chrysostomou, Enfield, Great Britain

[73] Assignee: The Whitaker Corporation, Wilmington, Del.

[21] Appl. No.: 556,476

[22] Filed: Nov. 13, 1995

[30] Foreign Application Priority Data

Nov. 18, 1994 [GB] United Kingdom ..... 9423346

[51] Int. Cl.[6] ..... H01R 13/627

[52] U.S. Cl. ..... 439/352; 439/188; 439/357; 439/152

[58] Field of Search ..... 439/188, 352, 439/353, 357, 489, 152; 200/51.09, 51.1

[56] References Cited

U.S. PATENT DOCUMENTS

| | | | |
|---|---|---|---|
| 3,639,890 | 2/1972 | Stevens et al. . | |
| 3,808,590 | 4/1974 | Hemmer et al. . | |
| 4,170,939 | 10/1979 | Hoheisel et al. | 102/28 S |
| 4,271,453 | 6/1981 | Yajima et al. | 361/248 |
| 4,435,742 | 3/1984 | Cecil, Jr. | 429/347 |
| 4,548,455 | 10/1985 | Ezure . | |
| 4,880,393 | 11/1989 | Moji | 439/352 |
| 4,929,189 | 5/1990 | Sekiguchi | 439/352 |
| 5,275,575 | 1/1994 | Cahaly et al. | 439/188 |
| 5,314,345 | 5/1994 | Cahaly et al. | 439/188 |
| 5,318,457 | 6/1994 | Harting et al. | 439/357 X |
| 5,529,512 | 6/1996 | Mlyniec | 439/352 |

FOREIGN PATENT DOCUMENTS

| | | | |
|---|---|---|---|
| 0 551 128A1 | 7/1993 | European Pat. Off. . | |
| 0 591 947-A2 | 4/1994 | European Pat. Off. | H01R 13/639 |
| 0 432 368-B1 | 11/1994 | European Pat. Off. | H01R 13/703 |
| 0 624 929-A1 | 11/1994 | European Pat. Off. | H01R 13/703 |
| 0 632 546-A2 | 1/1995 | European Pat. Off. | H01R 31/08 |
| 0 632 534-A2 | 1/1995 | European Pat. Off. | H01R 13/506 |
| 0 650 229-A2 | 4/1995 | European Pat. Off. | H01R 23/10 |
| 44 19025-A1 | 12/1994 | Germany | B60R 21/26 |
| 2267188-A | 11/1993 | United Kingdom | H01R 13/66 |

OTHER PUBLICATIONS

European Search Report (US 5,272,575 was included in earlier IDS statement).

*Primary Examiner*—Khiem Nguyen

[57] ABSTRACT

An electrical interconnection system having a base unit with a cavity therein containing electrical terminals, an electrical connector adapted to be received within the cavity for mating with the terminals, a shorting clip having contact arms for shorting together at least two of the terminals within the cavity, the contact arms being displaceable therefrom in response to the insertion of the connector, and a retention system for positive retention of the connector to the base disposed along the side of the cavity; characterized in that the shorting clip is disposed at the bottom of the cavity and the contact arms are collapsible out of engagement with the terminals in response to the insertion of the connector. The interconnection system advantageously having minimal effect on the structure of the base and plug connector where the collapsible aspect of the shorting clip enables incorporation of the retention system along the side of the cavity.

15 Claims, 7 Drawing Sheets

ELECTRICAL INTERCONNECTION SYSTEM HAVING RETENTION AND SHORTING FEATURES

BACKGROUND OF THE INVENTION

1. Field of the Invention

This invention relates to electrical interconnection systems and, more particularly, to electrical interconnection systems where the terminals of one of the components are to be shorted together until mating with the second component and where the mating components may be positively retained together.

2. Description of the Prior Art

The interconnection system of the present invention may be adapted for use in vehicle airbag systems. These airbag systems typically include an airbag unit mounted within the cabin of the vehicle relative the occupants and a controller which is mounted in a convenient location away from the airbag unit(s). In order to deploy the airbag, a squib is activated by the controller. The squib would typically be included within a base unit upon the airbag unit. The base unit would include an opening for receiving an electrical connector in order to form an electrical path between the squib and the controller. The electrical interconnection system enables the airbag unit and the controller to be independently mounted and later easily interconnected.

One example of an electrical connector suited for interconnecting the controller and the squib within the base is disclosed in UK Application No. 9417215.2, filed on Aug. 25, 1994. This connector comprises a generally T-shaped housing having an upper portion carrying a suppression device and multiple contacts for engaging conductors that are ultimately connected to the controller. The contacts extend into the plug portion and are adapted to mate with the terminals of the squib. The plug unit includes openings for receiving the terminals of the squib, which are typically pins.

While effective electrical interconnection may be established between the conductors that are interconnected to the controller and the terminals of the base by way of the above described connector, it is desirable to assure that the squib can not be activated inadvertently when the connector is not attached thereto. This is typically accomplished by including a shorting function that electrically shorts together the terminals in the base. Known ways to accomplish this include a shorting clip with resilient contact arms that extend along the sides of the opening or cavity wherein the pins are installed. These contact arms are commoned and have a natural first position against the pins. In response to insertion of the connector, they are displaced away from the pins, thereby breaking the commoning and enabling the system. One problem with the present systems is that they typically include a shorting clip disposed within an insulating housing which is then seated within the cavity or opening.

This requires the cavity or opening to be larger than required, thereby requiring the portion of the base unit to be larger than would be required to serve its other functions.

In addition, another feature that may be desirable to incorporate into the interconnection system is to have the connector be positively retained within the cavity. This positive retention could be achieved either by structure that assures that the connector cannot be dislodged from the base without such extensive damage to the interconnection system that it would be extremely difficult to mate another connector or by having a release mechanism incorporated into the system that enables the connector to be separated only in response to an affirmative action. The first solution has the advantage of preventing any dislodgement, thereby requiring the whole system to be replaced. The second system has the advantage of enabling easier servicing, as the whole unit would not have to be replaced because the connector could simply be disengaged. Present positive retention systems have a number of problems. For the purposes of this application, the largest being that the retention features usually are incorporated into the sidewalls of the opening or cavity of the base unit. If the interconnection system includes the above desirable feature of a shorting clip, the two features are now competing for the same space. One system that attempts to solve this problem is presented in U.S. Pat. No. 5,314,345 that includes a separate interlock that is insertable into the system to hold the connector with the base. One problem with this is that during assembly the lock element may have been lost or is forgotten to be installed. In addition, it is a problem with the systems to provide positive retention while still enabling detachment if desired.

SUMMARY OF THE INVENTION

In light of the above, it is an object of the present invention to provide a simple, easy to manufacture interconnection system having a shorting feature that is minimally intrusive on the base configuration.

It is an object of the present invention to provide a simple and easily manufactured positive retention system that does not require additional installer steps beyond the insertion of the connector into the cavity of the base unit.

It is a feature of the shorting clip that it may easily be incorporated into an interconnection system having positive retention features, if desired. It is another feature that the shorting clip is easily manufacturable. It is a yet another feature of the shorting clip that if desired the shorting clip may be formed integrally with the positive retention system components.

It is a feature of the positive retention system, that if desired, it may be incorporated into an electrical interconnection system having a shorting clip according to the present invention and still provide positive retention. It is another feature of the retention system that it is minimally intrusive on the configuration of the cavity within the base unit. It is yet another feature of the base unit that the retention system may be adapted to provide an audio "click" upon full insertion of the connector, and furthermore, if desired upon assembly of the components to assure full and proper assembly occurs. It is still another feature of the invention that, in response to a positive act the connector could be dislodged from the base unit. It is still yet another feature that if improper disassembly occurs the cavity of the base unit could be prevented from receiving another connector.

At least one of the forgoing objects or features is accomplished by providing an interconnection system comprising a base unit with a cavity therein containing electrical terminals, an electrical connector adapted to be received within the cavity, and a retention collar carried upon the connector for retaining the connector within the cavity, characterized in that the retention collar is engageable by the lances extending from a sleeve positioned along the sidewalls of the cavity.

At least one of the forgoing objects or features is accomplished by providing an interconnection system comprising a base unit with a cavity therein containing electrical terminals, an electrical connector adapted to be received within the cavity, and a retention collar carried upon the connector for retaining the connector within the cavity, characterized in that the retention collar is engageable by the lances extending from a sleeve positioned along the sidewalls of the cavity and the electrical connector carries a sleeve telescopically thereupon that is also telescopically received with the cavity for disengaging the retention collar.

DETAILED DESCRIPTION OF THE PREFERRED EMBODIMENT

While the invention has been described above in relation to an "airbag-system" that would typically be incorporated into some kind of a vehicle, the present invention, while particularly suited for that application, may be applied to other applications as will be apparent from the description below. Furthermore, terms such as "above", "below", "forward", "rearward", etc. refer to the orientation of the figures or the direction of assembly and are simply used for convenience of description.

Figure 1:
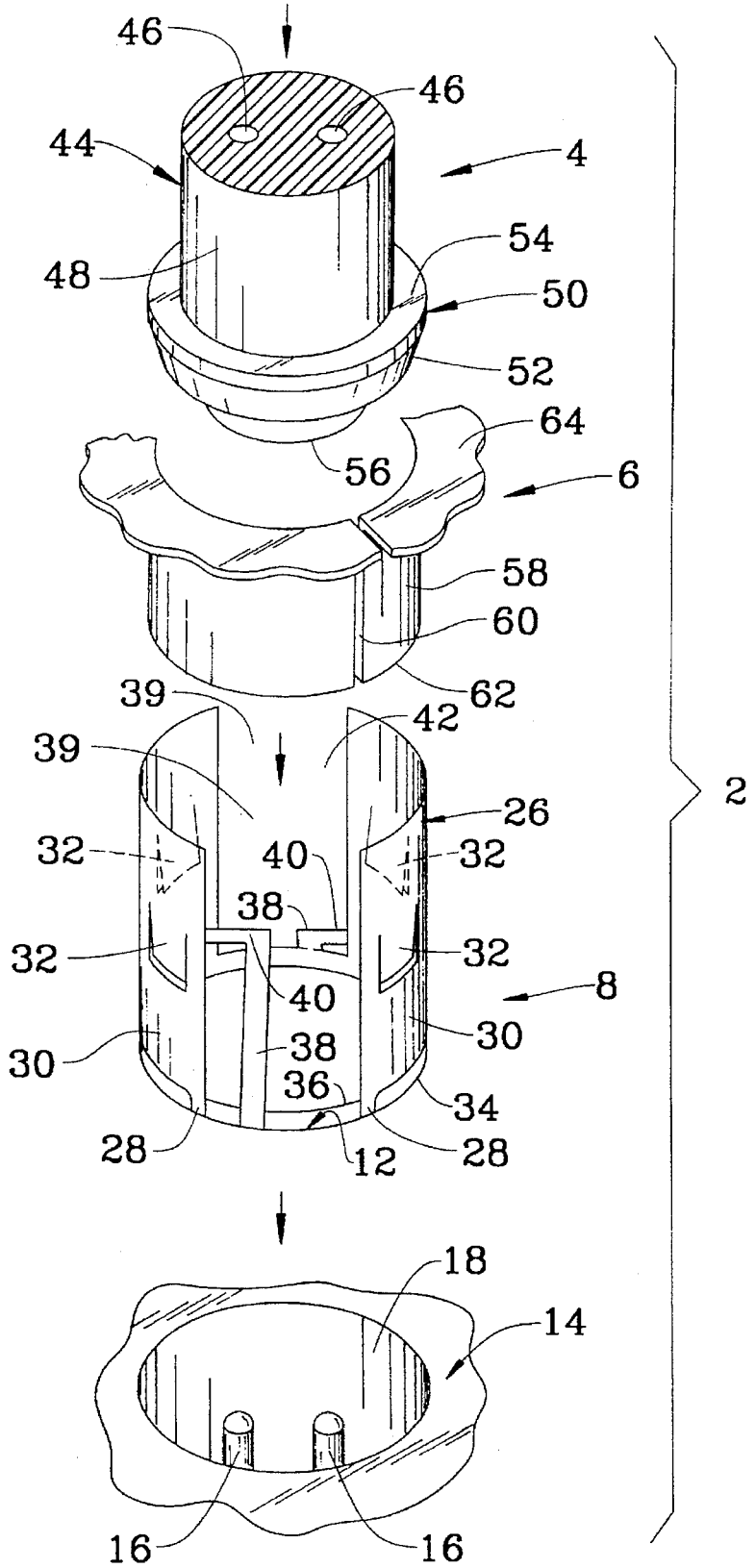
FIG. 1 is a partially broken-away exploded view of an electrical connector system of the present invention.

With reference first to FIG. 1, an electrical interconnection system according to the present invention is shown generally at 2. This interconnection system includes a mating connector partially shown at 4. In this particular embodiment, a release collar 6 is included that would fit on the connector 4. A retention member 8, which in this case integrally incorporates a shorting clip 12, will be seated within a base 14 that is adapted for retaining the connector 4 therewith.

Figure 2:
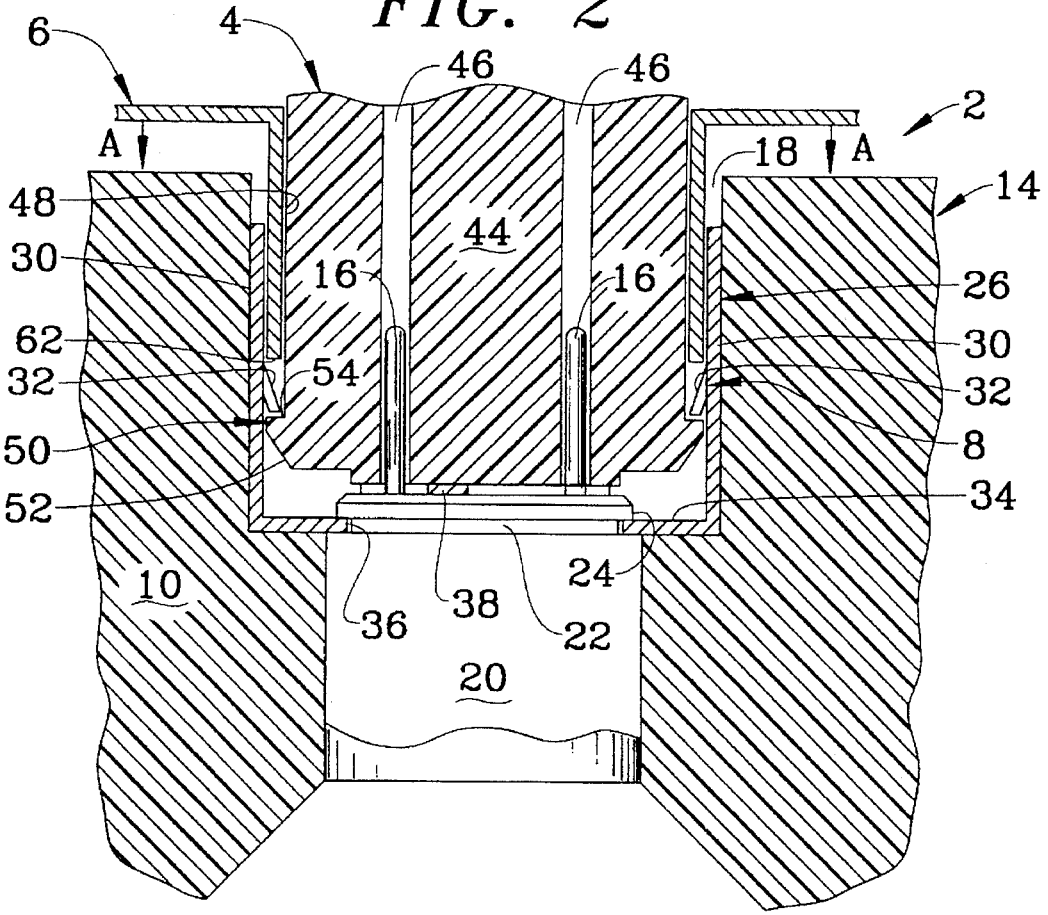
FIG. 2 is a fully interconnected side sectional view of the electrical interconnection system of FIG. 1.
Figure 3:
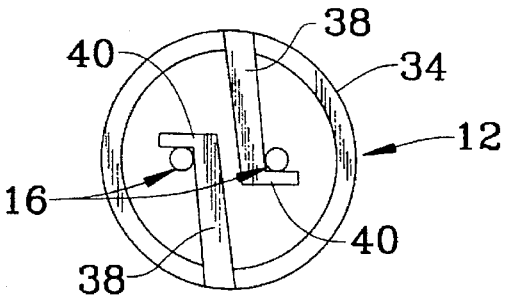
FIG. 3 is a top view of a shorting clip according to one aspect of the present invention showing the clip in a shorted position.

The base 14 includes a pair of pin terminals 16 within a cavity 18. As best seen in FIG. 2, the pin terminals 16 are moulded in a plug portion 20 seated at the bottom of the cavity 18. The plug 20 includes an undercut portion 22 located at the base of the cavity 18 and having an overlying head 24.

To be seated within the base 14 is the retention member 8. The retention member 8 includes an upper sleeve portion 26 interconnected to a shorting clip 12 by tabs 28. The upper sleeve 26 includes opposing side walls 30 each of which have a plurality of cantilevered lances 32 that are inwardly struck so that their free ends are facing downwards or opposite the direction of insertion of the connector 4. The outer diameter of the sleeve portion 26 is sized for a close sliding fit within the cavity 18. The integrally formed shorting clip 12 includes a ring-like base 34 having an interior perimeter edge 36. Extending from the ring-like base 34 are a pair of resilient contact arms 38 having a hook-like shape with an extreme leg 40 extending therefrom. These contact arms 38 have been stamped from the space that forms openings 39 that exist between the opposing side walls 30 of the sleeve portion 26. The contact arms 30 extend angularly upward from, and across, the base 34 and are disposed within the interior 42 of the retention member 8. The operation of the shorting clip 12 will be more fully described below with reference to FIGS. 3–6. The retention member 8 is inserted into the cavity 18 of the base 10 such that the interior perimeter edge 36 of the ring base 34 fits over the head 24 of the plug 20 where it is retained with the undercut portion 22, as best seen in FIG. 2.

Returning to FIG. 1, the pluggable connector 4 according to the description above is shown in partially broken-away form for the sake of clarity. A plug portion 44 having a pair of terminal receiving cavities 46 extending therethrough which would include the mating contacts (not shown) and provide access to the terminal pins 16. The plug portion 44 includes a central body 48 having an outwardly extending collar 50 that includes a ramp surface 52 for displacing the lances 32 of the retention member 8 as the plug portion 44 is inserted therein and a locking shoulder 54 that interferes with the free ends of the lances 32 for retention purposes. The body 48 further includes a base surface 56 that displaces the contact arms 38 to break the shorting interconnection, as will be described below.

The release collar 6 is formed in a split-ring fashion having a sleeve portion 58 divided by an opening 60 and a bottom edge 62. Opposite the bottom edge 62 is an upper flange 64 that will enable manipulation of the release collar 6 to disengage the connector 4 from the base 14. The opening 60 enables spreading of the release collar 6 so that it may pass over the collar 50 of the plug connector 4 for slidably seating upon the body 48 of the plug portion 44.

With reference now to FIG. 2, the interconnection system 2 is shown in a fully assembled and mated form. With the retention member 8 in place within the cavity 18 of the base unit 10 and the shorting clip 12 retained in the base thereof, the plug portion 44 of the plug connector 4, while carrying the release collar 6, may be fitted therein. As the plug member is plugged within the cavity 18 for engagement of the terminal pin 16, the collar 50 passes over the inwardly cantilevered lances 32 into its fully seated position where the free ends of the lances 32 would abut the locking surface 54 of the collar 50 to prevent disengagement should the plug connector 4 be attempted to be removed or be subjected to normal environmental influences, such as vibration. However, if removal is desired by displacing the release collar 6 in the direction of Arrows A, the ends 62 of the collar will push the lances 32 inward enabling the collar 50 to move upward therepast.

Figure 4:
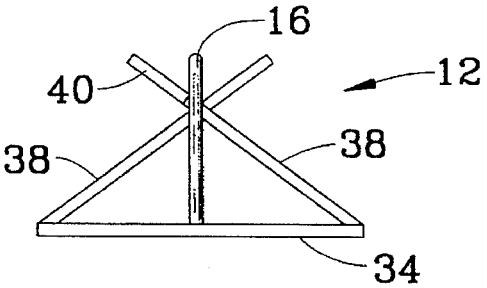
FIG. 4 is a side view of the shorting clip of FIG. 3.

With reference now to FIGS. 3–6, the workings of the shorting clip 12 will be described in detail. The shorting clip includes a base ring 34 from which a pair of resilient contact arms 38 extend therefrom upwardly and across in an angled manner. At the free ends of the contact arms 38 is a leg portion 40 extending approximately perpendicular thereto to form a hook-like structure. The length of the contact arms 38 is such that the leg 40 may be positioned on the opposite side of the terminal pin 16 and retained thereagainst by the hook-like configuration. However, the contact arm 38 is not sufficiently long to allow the leg 40 to pass over the contact pin 16 in response to the natural biasing of the arms 38, as best shown in FIG. 4.

Figure 5:
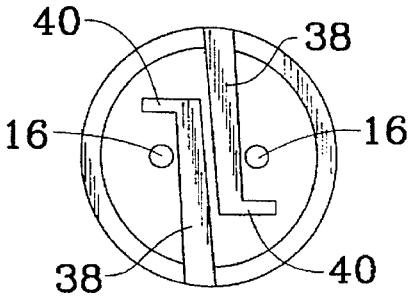
FIG. 5 is a top view of the shorting clip of FIG. 3 showing the shorting clip in a disengaged position.
Figure 6:
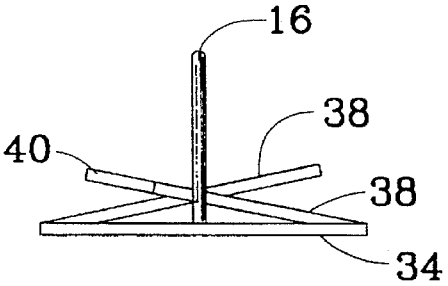
FIG. 6 is a side view of the shorting clip of FIG. 5.

With reference now to FIG. 5, as a collapsing force is exerted upon the contact arms 38 the leg portions 40 move away from the terminal pins 16 in an arc-like manner, thereby breaking the interconnection therebetween. As seen in FIG. 6, the contact arms 38 are shown in their collapsed position with the legs 40 away from the terminal pins 16 which would be the position obtained when the contact arms 38 have been displaced by the mating plug connector 4. Therefore, it is especially advantageous that the contact arms extend from a side of the pin opposite from where the leg engages enabling simple disengagement due to the arcuate travel of the arms 38 in response to the seating connector 4. The collapsing structure minimizes the space required for the shorting-clip 12 function and therefor the effect of the shorting clip on the overall structure. Additionally, by having the shorting clip 12 positioned beneath the connector 4 the sides of the cavity are left free for incorporating the retention features therealong.

Figure 7:
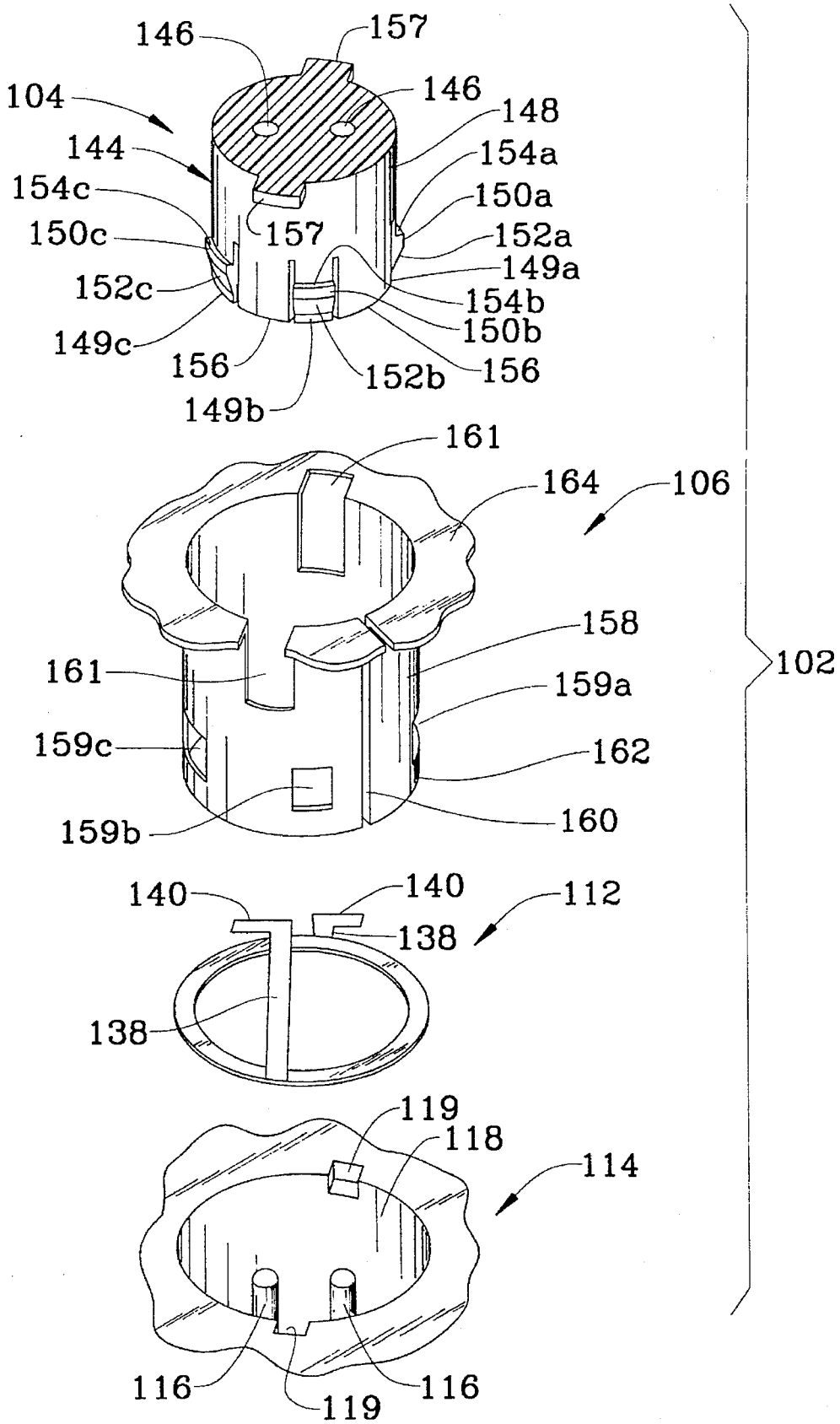
FIG. 7 is a partially broken-away and exploded perspective view of an alternative embodiment of an electrical interconnection system according to the present invention.

With reference now to FIG. 7, an alternative embodiment of the interconnection system of the present invention is shown generally at 102. In this embodiment, mating plug connector 104 includes a plug body 144 having a body portion 148 with a plurality of resiliently deflectable legs 149*a–c*. In this embodiment, collar portions 150*a–c* are carried on each of the resilient legs 149*a–c* respectively. Each collar portion 149*a–c* includes a ramp surface 152*a–c* and a locking shoulder 154*a–c* respectively. A pair of terminal receiving cavities 146 extend downwardly through the body to enable the electrical interconnection to be formed. The resilient legs 149 are cantilevered from the plug body 144 so that they have a free end at the base surface 156 and opposite thereof are a pair of anti-rotation tabs 157 which would interact with the base 114 to prevent the plug connector 104 from moving relative thereto, thereby protecting the pins 116 from the exertion of excessive forces.

The base unit 114 includes an interior 118 having a pair of pins 116, as described above. A pair of anti-rotation tab receiving notches 119 are included therein for receipt of the anti-rotation tabs 157 of the mating plug connector 104. As previously described, the cavity 118 would include a plug 120 carrying the pins and having a similar undercut portion 122 and head 124 as described above. An anti-rotation feature, accomplishing the same goal as that described with reference to this embodiment is fully envisioned as being incorporated into all embodiments. Additionally, it may be desirable to incorporate keying or polarizing features also.

In this embodiment, the retention member 106 includes a sleeve portion 158 and a flange 164 that are split by an opening 160. Opposite the flange 164 is a bottom edge 162. The sleeve portion 158 includes a plurality of windows that correspond to each of the collar segments 150*a–c* and a pair of clearance slots 161 that correspond to the anti-rotation tabs 157 on the plug connector 4. The release sleeve 106 is fitable over the retention members 150*a–c* of the pluggable connector 104 so that the retention members 150*a–c* fit within respective windows 159*a–c* and the anti-rotation features are movably received within the slots 161.

Figure 8:
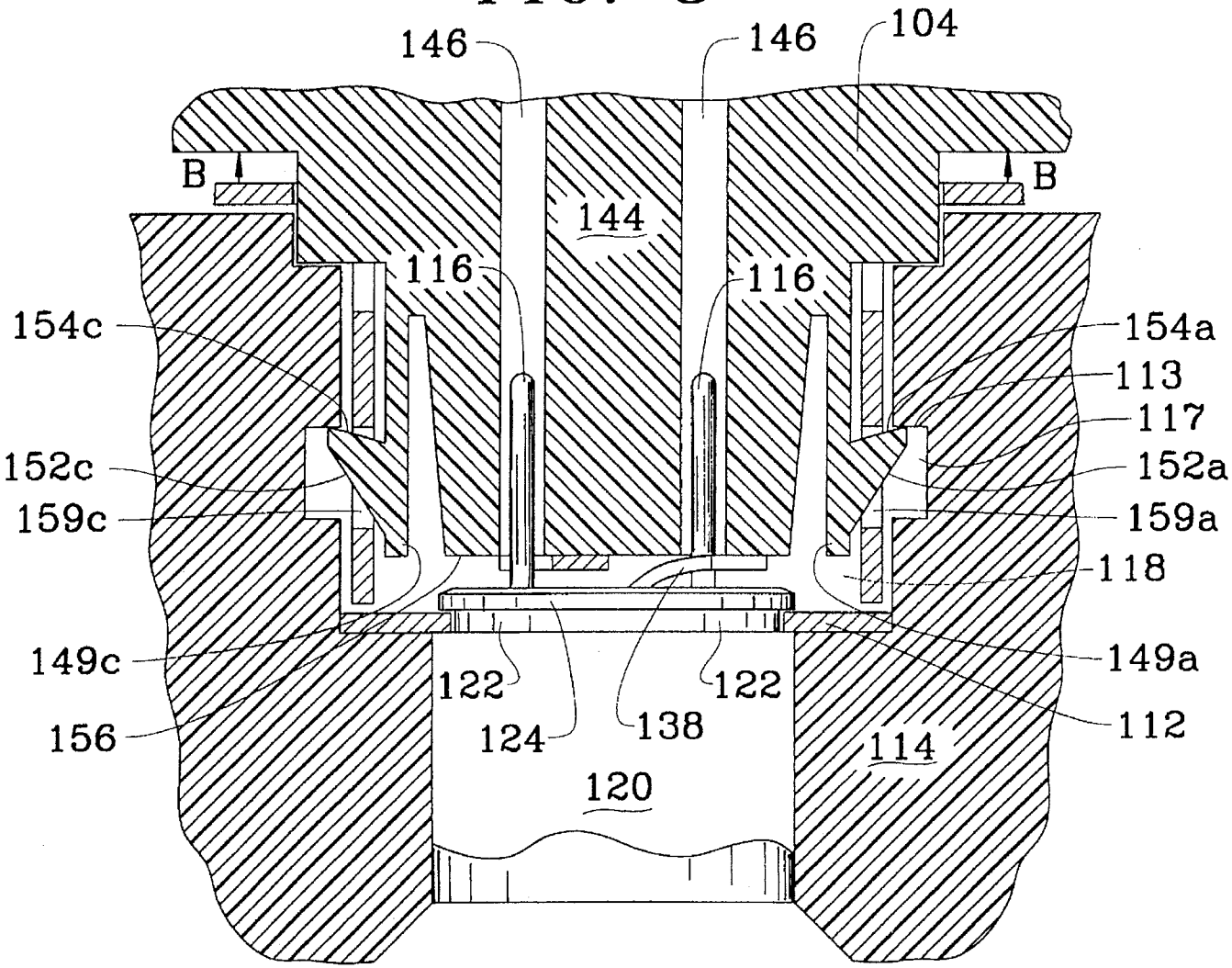
FIG. 8 is a side sectional view of the fully assembled interconnection system of FIG. 7.

With reference now to FIG. 8, the pluggable connector 104 is seated within the base 110 to electrically engage the terminal pins 116. The cavity 118 further includes an annular recess 117 extending therearound. It is important to note that this annular recess 117 could be segmented into individual notches if desired. The recess 117 includes a locking shoulder 113 that is engageable by the locking surface 154 of the locking collar segments 150. As the pluggable connector is inserted into the cavity 118, the resilient legs 149*a–c* deflect inward allowing the collar segments 150*a–c* to clear the interior walls of the cavity 118. Once the segments 150*a–c* reach the annular recess 117 they may spring outward through their respective windows 159 and engage the shoulder 113 of the recess 117 for positive retention. In order to remove the connector 104 from the base unit 114, the collar is displaced upward in the direction of Arrows B which cause the edges of the windows 159 to interact with the ramp surfaces 152 on the resilient legs 149, thereby deflecting the network and enabling the plug connector 104 to be removed.

Figure 9:
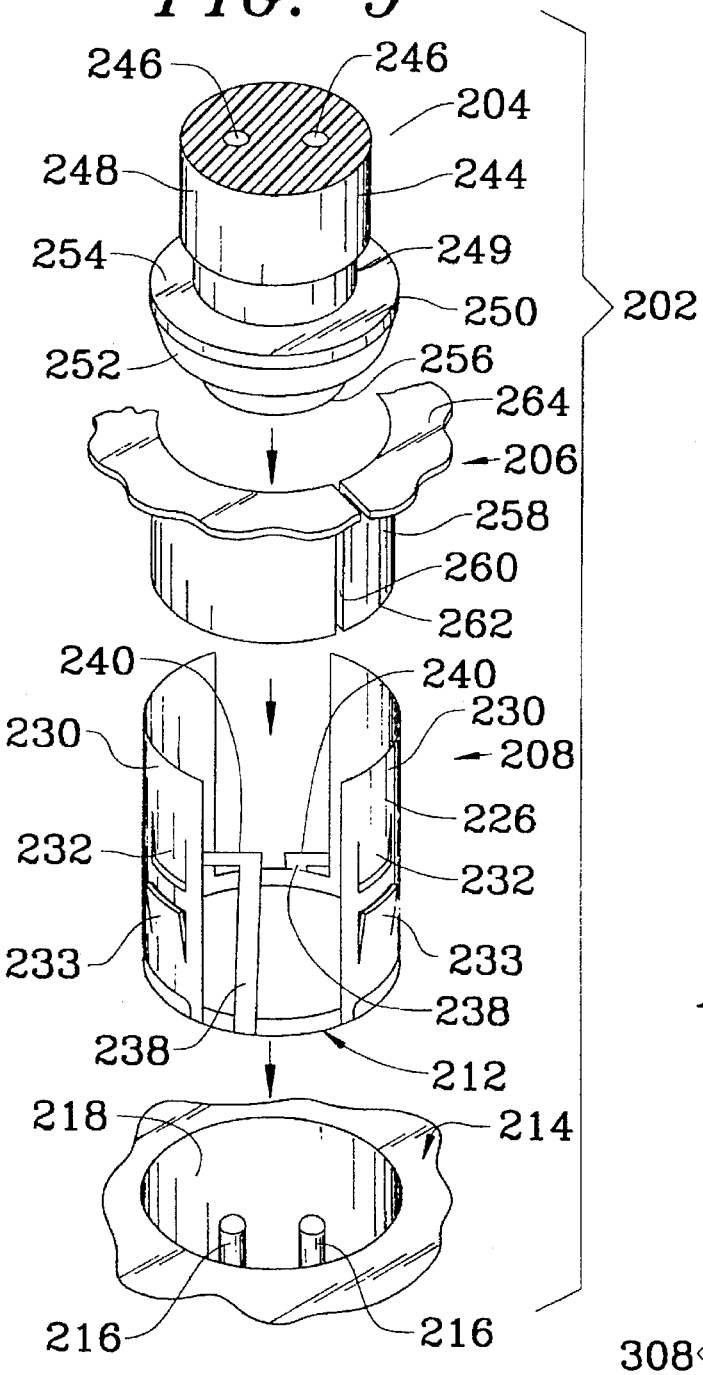
FIG. 9 is a partially broken-away and exploded perspective view of yet another alternative embodiment of the present invention.

With reference now to FIG. 9, another embodiment of the present invention is shown generally at 202. In this embodiment, the pluggable connector 202 has a plug portion 244 with terminal receiving cavities 246 extending therethrough and is adapted for mating with a base 214 within a cavity 218 to electrically engage terminals 216. The plug connector 204 includes a cylindrical body section 248 and a retention collar 250 having a locking shoulder 254 and a ramp surface 252 for enabling easier assembly. The plug portion 244 further includes a base surface 256 and a relieved portion 249 formed as an annular groove about the plug body 248 at the locking shoulder 254. A release collar 206 having a sleeve portion 258 and a flange portion 264 split by an opening 260 may also be included if it is desired to disengage the connector from the mating body 114. The release collar 206 fits upon the body 248 of the plug portion 244 as has been previously described.

Figure 10:
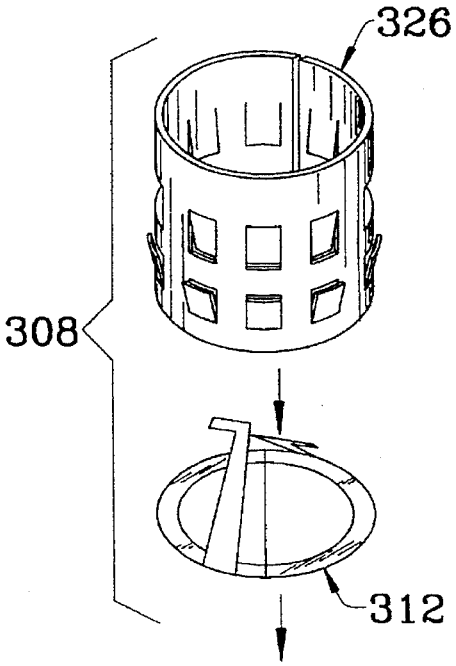
FIG. 10 is a side perspective view of an alternative method of manufacturing one of the components incorporated into the interconnection systems of FIG. 1 and FIG. 9.

A retention member 208 incorporates a shorting clip 212. The retention member 208 includes side walls 230 defining a sleeve portion 226. Folded inward from the side walls 230 are retaining lances 232. These lances are cantilevered from the side walls 230 so that their free end is facing downward towards the base 214. Also struck from the side walls 230 are stakes 233 that are folded outward from the side walls and have their free ends facing upward. The side walls 230 are integrally formed with the shorting clip 212 which includes the resiliently collapsible contact arms 238 having the terminal engaging legs 240 thereupon. If desired, the retention member 208 could be formed as two distinct members 326 and 312 as shown in the embodiment of the retention member 308 of FIG. 10.

Figure 11:
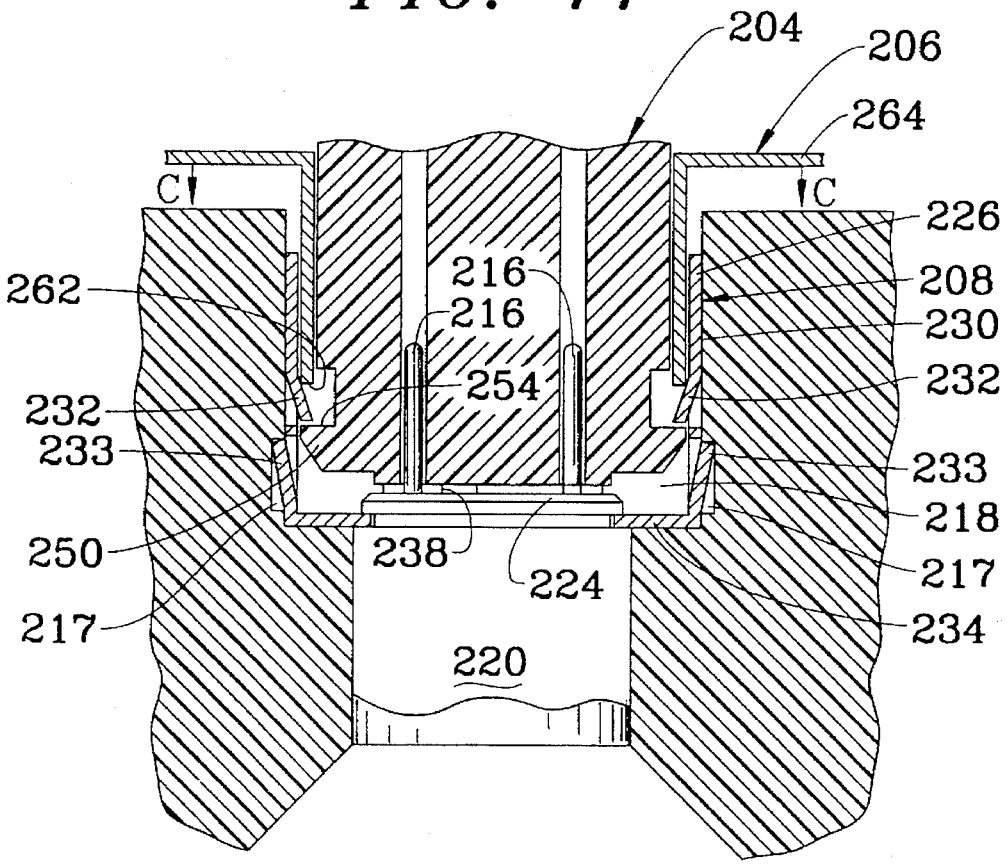
FIG. 11 is a side sectional view of a fully assembled interconnection system of FIG. 10.
Figure 12:
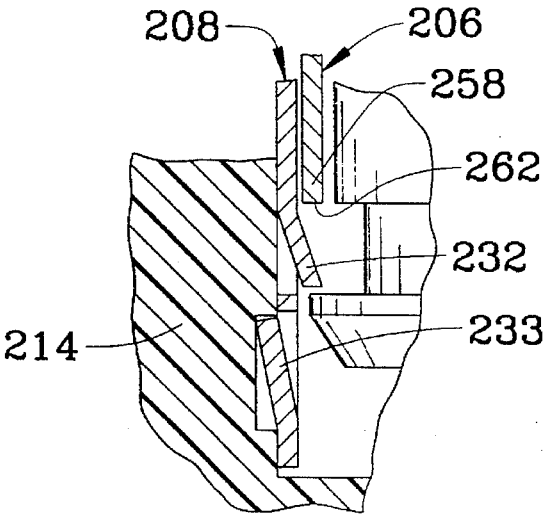
FIG. 12 is a side sectional detailed view of the interconnection system shown in FIG. 11.
Figure 13:
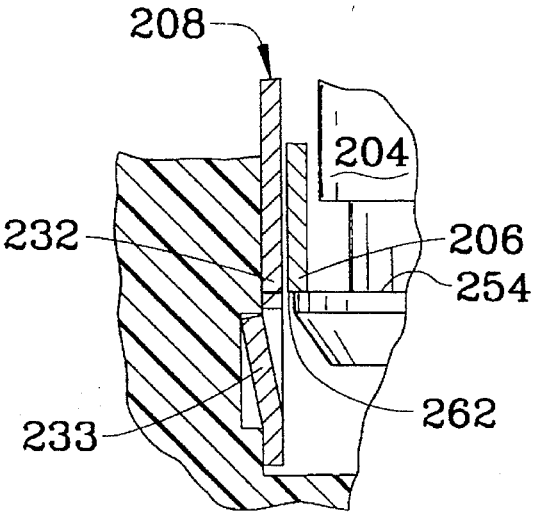
FIG. 13 is a side sectional view of the interconnection system of FIG. 11 showing the release mechanism.

With reference now to FIG. 11, the retention member 208 is seated within the cavity 218 so that the retention lances 232 are received within an annular groove 217 to prevent the retention member 208 from being removed from the cavity 218. The base 234 of the shorting clip 212 is also retained under the head 224 of the plug 220. As the plug connector 204 is inserted into the cavity 218, the lances 232 are deflected inward until the collar 250 passes thereby. Once it passes the free end of the locking lances 232 they may resiliently snap back over the shoulders 254 so that the plug connector 204 is prevented from being withdrawn unless the release collar 206 is displaced downward in the direction of Arrow C which would bring the bottom edge of the release collar 262 against the locking lances 232 and deflect them out of the way so that the plug may be removed as shown in FIGS. 12 and 13.

Figure 14:
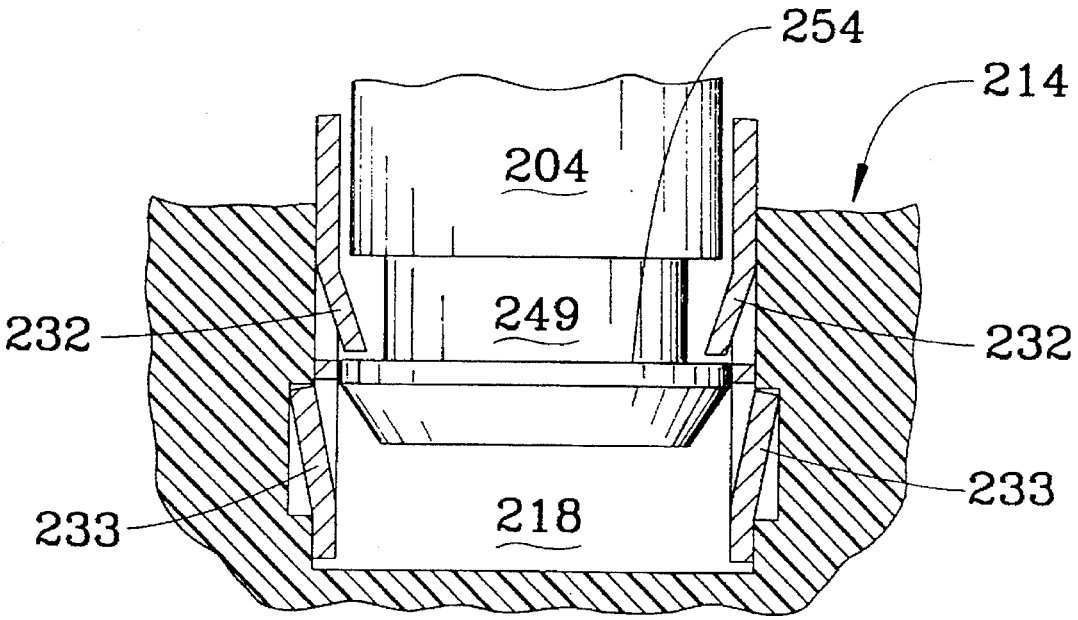
FIG. 14 is a side sectional view of the interconnection system of FIG. 11 where the release mechanism is omitted.
Figure 15:
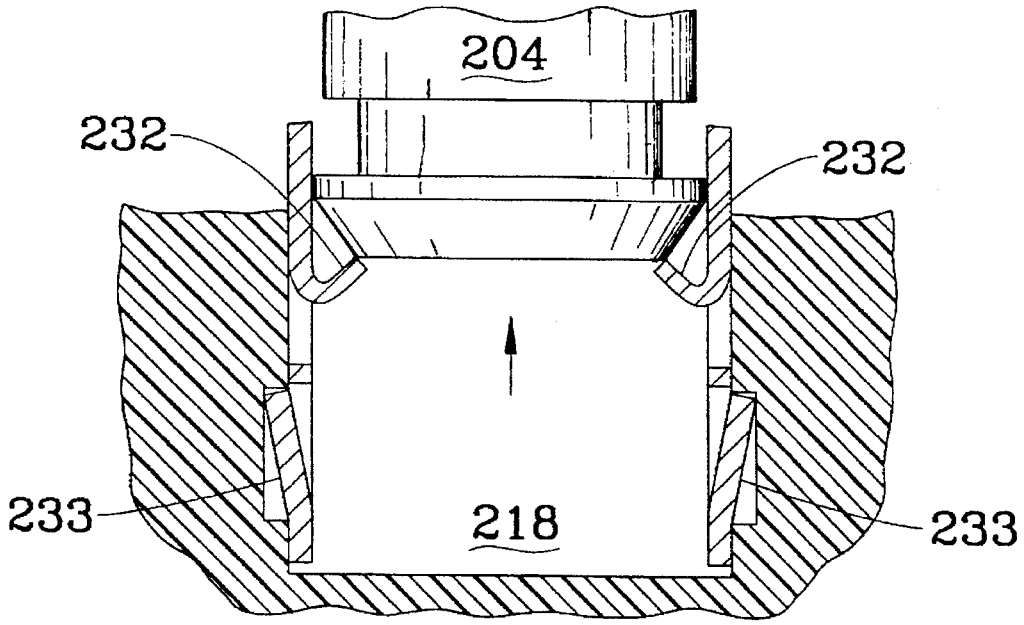
FIG. 15 is a side sectional view of the interconnection system of FIG. 14 showing the mating connector having been forced from the base unit.

With reference now to FIG. 14 and FIG. 15, the embodiment described in FIG. 9 is shown without the release collar 206. Furthermore, the plug 220 has been removed for clarity sake. By having the locking latches 232 disposed at a greater angle than the corresponding retention lances 233, that maintain the retention member 208 within the cavity 218. Forced withdrawal of the plug connector 204 will result in failure of the locking latches 232 before failure of the retention latches 233. Once this occurs, as shown in FIG. 15, the locking latches 232 will be folded back upon themselves to such a degree that it would be impossible to insert another connector 204.

In all of the embodiments described above, it is fully envisioned that as the mating plug connector 4,104,204 is inserted into the mating body 14,114,214 the locking latches 32,149,232 of the retention member may be configured to omit an audible "click". The "click" would provide an indication that a plug is fully inserted and retained therein. In addition, the retention latches 233 of the retention member 208 might also emit a "click" when they are seated in the annular ring 217. Finally, it is also envisioned that the base ring of the shorting clip may include tab portions that would enable easier seating over the head of the plug. In the alternative, the tabs may be formed on the head 224 to serve the same purpose.

I claim:

1. An electrical interconnection system for an automotive airbag system comprising a base unit with a cavity having a pair of terminals therein, a connector having a plug portion extending therefrom where said connector would include contacts complementary to said terminals that are accessible through said plug portion when received in the cavity and retention members for holding the connector to the base unit wherein the retention members are configured for positive engagement to prevent disengagement of the system without destruction of a component thereof and a disengagement member for separating the retention members so that the system can be demated without destruction thereof.

2. The electrical interconnection system of claim 1 further characterized in that the disengagement member is carried on the connector.

3. The electrical interconnection system of claim 1 further characterized in that the retention members are a resilient lance and a shoulder whereupon insertion of the plug into the cavity the lance is deflected until passing the shoulder whereupon the lance deflects outward such that removal of the connector is prevented by interference between the lance and shoulder.

4. The electrical interconnection system of claim 3 further characterized in that the lance is carried on a sleeve member received within the cavity and a collar having a shoulder is on the plug.

5. The electrical interconnection system of claim 2, further characterized in that the disengagement member is a collar slidably disposed upon the plug.

6. The electrical interconnection system of claim 4 further characterized in that a shorting member for shorting the terminals together is disposed within the cavity, said shorting member having a first position shorting the terminals and a second position obtainable when the contacts and terminals are mated where the short is defeated.

7. The electrical interconnection system of claim 6 further characterized in that the shorting member is connected to one of the retention members.

8. The electrical interconnection system of claim 7 further characterized in that the shorting member and retention member are formed as part of a single component.

9. An electrical interconnection system for an automotive airbag system comprising a base unit with a cavity therein wherein a pair of electrical terminals are disposed, said base unit including a shorting member that has a first position where the pair of electrical terminals are shorted together and a second position where the short of the first position is defeated, a connector having a plug portion adapted to be received in said cavity where contacts are disposed within the connector that include a complementary portion for engaging respective one of the terminals, said contacts being accessible through paid plug, the shorting member being displaceable to the second position once the terminals and contacts are mated, the interconnection system wherein a resilient retention lance on the base unit cooperates with a shoulder on the connector or base unit to secure the connector and base unit together where as the connector is inserted into the base unit the resilient retention lance is deflected until passing the shoulder whereupon the lance resiles such that the lance and shoulder interfere to prevent unmating and a disengagement member is inserted into the mated connector and base unit to deflect the lance from the shoulder, whereby the connector is separable from the base unit.

10. The electrical interconnection system of claim 9, wherein the disengagement member is mounted on the connector.

11. The electrical interconnection system of claim 9, wherein the shorting member is connected to the lance.

12. The electrical interconnection system of claim 9, wherein the lance extends into the cavity from a sleeve received therein, said sleeve being captivated in the cavity.

13. The electrical interconnection system of claim 9, wherein the disengagement member is a slidable collar telescopically received upon the plug.

14. An interconnection system comprising a base unit with a cavity therein containing electrical terminals, an electrical connector adapted to be received within the cavity, and a retention collar carried upon the connector for retaining the connector within the cavity, characterized in that the retention collar is positively engageable by lances extending from a sleeve positioned along the sidewalls of the cavity and the electrical connector carries a sleeve telescopically thereupon that is also telescopically received with the cavity for disengaging the lances from the retention collar.

15. The interconnection system of claim 14, further characterized in that if the connector is improperly withdrawn from the cavity another connector may not be reseated therein.

* * * * *